United States Patent [19]

Schwaikert

[11] Patent Number: 4,485,923

[45] Date of Patent: Dec. 4, 1984

[54] STACKABLE CONTAINER

[75] Inventor: Ralph A. Schwaikert, Lakeville, Conn.

[73] Assignee: RASCO Incorporated, Lakeville, Conn.

[21] Appl. No.: 381,138

[22] Filed: May 24, 1982

[51] Int. Cl.[3] ..... B65D 21/02

[52] U.S. Cl. ..... 206/508; 206/503; 206/509

[58] Field of Search ..... 206/503, 508, 509

[56] References Cited

U.S. PATENT DOCUMENTS

| | | | |
|---|---|---|---|
| 1,552,134 | 9/1925 | Frey | 206/508 |
| 2,304,912 | 12/1942 | Henchert | 206/508 |
| 2,367,300 | 1/1945 | McManus et al. | 220/277 |
| 2,641,374 | 6/1953 | Der Yuen | 215/10 |
| 2,978,142 | 4/1961 | Novick | 206/508 |
| 3,001,564 | 9/1961 | Hopkins | 206/509 |
| 3,019,956 | 2/1962 | Muhlhoff | 206/508 |
| 3,065,558 | 11/1962 | Loewy | 206/509 |
| 3,091,361 | 5/1963 | Gawron | 206/508 |
| 3,207,359 | 9/1965 | Heesler et al. | 220/94 |
| 3,217,915 | 11/1965 | Weygandt | 215/10 |
| 3,587,904 | 6/1971 | Harris et al. | 206/509 |
| 3,598,271 | 8/1971 | Holley | 215/321 |
| 3,624,789 | 11/1971 | Peyser et al. | 220/307 |
| 3,642,169 | 2/1972 | Webster et al. | 206/509 |
| 4,315,578 | 2/1982 | Ludwig, Jr. | 220/336 |
| 4,356,930 | 11/1982 | Roper | 206/508 |

FOREIGN PATENT DOCUMENTS

| | | | |
|---|---|---|---|
| 400766 | 11/1933 | United Kingdom | 206/503 |

*Primary Examiner*—George E. Lowrance

*Attorney, Agent, or Firm*—Panitch Schwarze Jacobs & Nadel

[57] ABSTRACT

A stackable, closable container is provided. The container has a generally cylindrical body portion and generally circular top and bottom end walls. The container has an opening at its top end wall and is plugged with a resiliently flexible cover. In a preferred embodiment, the cover acts as a child-resistant closure. The cover also acts as a female member which receives a male member on the bottom end of an identical container stacked above it. The weight of the top container, however, is supported by the raised flange on the top end wall of the container beneath it, such that no weight is supported by the closure itself. Additionally, the top raised flange of the container and its bottom chime extend outwardly approximately an equal distance such that when one container is adjacent to an identical container in a side-by-side relationship there is a space between the containers so as to avoid scuffing of the containers or labels affixed thereto.

3 Claims, 3 Drawing Figures

STACKABLE CONTAINER

BACKGROUND OF THE INVENTION

The present invention concerns a stackable container. More particularly, this invention relates to a container having a plug-type closure, wherein when identical containers are stacked one upon another. The plug-type closure acts as a locking device.

In the manufacture of containers designed for marketing household articles such as cleaning products, food products and other commodities, such containers are conventionally made in such a manner that it is difficult to stack them one upon another and maintain the same in stacked arrangement. Considering the conventional metal or plastic cans, for example, these are generally made with flat end walls usually flanged around the edge and of the same diameter from one end to another. Accordingly, when such cans are placed one upon another, there is only a narrow edge-to-edge contact between the flange at the top end of one can and the flange at the bottom end of the overlying can. As a result, such cans or containers can be easily knocked out of position and will slip one from the other until the entire stack collapses. The slipping or falling of cans from an original stacked arrangement could result in great inconvenience and even risk of injury to people adjacent to the stack at that time. Furthermore, cans may be damaged as a result of falling due to ineffective stacking thus leading to economic loss to the merchant. Additionally, if the contents of the can were to contain a material, such as drain cleaner containing lye, a health hazard would result if the can were to be fractured and its contents were to be displaced from the container.

Exemplary of patents concerning stackable cans, containers and the like are U.S. Pat. Nos. 1,552,134; 2,367,300; 2,641,374; 2,978,142; 3,001,564; 3,065,558; 3,091,361; 3,207,359; 3,217,915; 3,587,904; 3,598,271; 3,642,789 and 3,642,169.

In some of the aforesaid patents, the uppermost can or container would have virtually no resistance to falling in the event that the stack is bumped or shaken. Furthermore, many of the stacking systems disclosed above do not employ the container closure as part of the stacking mechanism. In some instances where the container closure is utilized in a stacking function, the closure itself may have to bear all or most of the weight of the containers above it.

It would be advantageous to have a stackable container in which the container closure aids in the stacking of one identical container upon another, but where the closure does not itself bear the weight of the containers above it.

SUMMARY OF THE INVENTION

The present invention concerns a stackable, closable container. The container includes a body portion having an upper end and a lower end. A top end wall is joined to the upper end of the body portion. The top end wall has an opening. The top end wall also has an axially extending raised flange disposed on its periphery.

A generally circular, removable cover engages the opening. The cover has top and bottom surfaces. The cover has a raised rim on the periphery of its top surface. When the cover closes the opening, the top of the raised rim is higher than the top of the raised flange.

A bottom end wall is joined to the lower end of the body portion of the container. The bottom end wall has an axially extending chime on its periphery. The bottom end wall of the container also has an annular raised ring which is disposed between the center of the bottom end wall of the container and the chime. The annular raised ring is of sufficient dimensions, configuration and proper location so as to snugly friction interlock with the cover of another container of duplicate construction to that as defined above so as to firmly couple one container in stacked relation to another container. In such a stacked configuration, the containers may be tilted at a substantial angle from the vertical without separating the coupled containers. When the containers are in a stacked relationship, the chime of one container rests upon the raised flange of the container beneath it.

The combined depths of the raised flange and the chime are greater than the distance from the end wall of the container to the top of the raised rim.

Advantages of the present invention are set forth hereinafter.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE INVENTION

Figure 1:
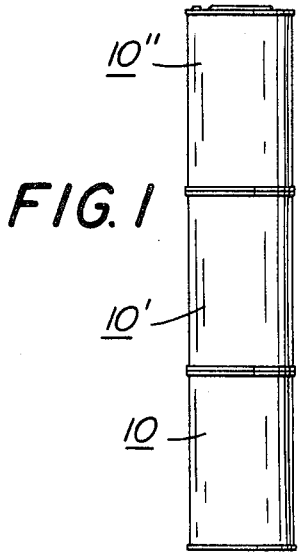
FIG. 1 is an elevational view showing three identical containers in stacked arrangement in accordance with this invention.

Referring to the drawings in detail, wherein like numerals indicate like elements, there is shown in FIG. 1 three identical containers 10, 10', 10''. The containers 10, 10', 10'' as shown are all cylindrical, but they may be of any other convenient shape other than cylindrical, such as for example, rectangular. Containers 10, 10', 10'' can be fabricated from any suitable material such as, for example, plastic or metal.

Figure 2:
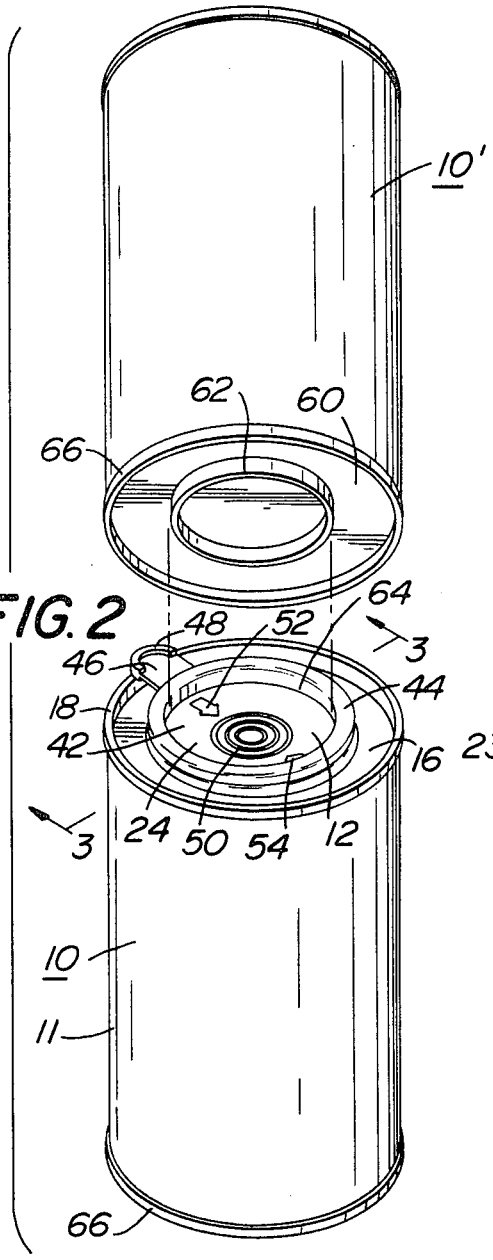
FIG. 2 is a perspective exploded view showing two of the containers of FIG. 1 in a separated configuration.
Figure 3:
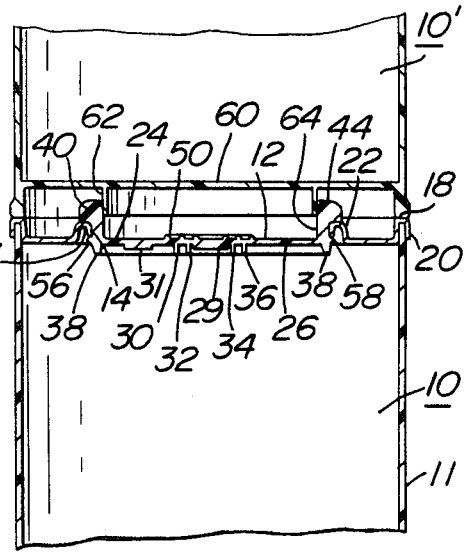
FIG. 3 is a sectional view taken along line 3—3 in FIG. 2 but with the containers stacked.

As shown in FIGS. 2 and 3, container 10 has a side wall 11 and a generally circular top end wall 16. The top end wall 16 has an opening 14 which is preferably circular. As shown in FIGS. 2 and 3, the opening 14 is plugged by a cover 12. Surrounding the opening 14 is a raised downwardly curved surface 22. An axially raised flange 18 surrounds the periphery of the top end wall 16 of container 10. The axially raised flange 18 preferably has a curved top surface and has a lip 20 which overlaps the top of the side wall 11 of container 10 (see FIG. 3). Cover 12 is removable and generally circular. Cover 12 is resiliently flexible and can be fabricated from any convenient material such as plastic. Cover 12 is designed to snap-fit engage with the opening 14 of container 10.

The cover 12 has a generally circular planar member 24. The planar member 24 has a reinforced section 28 on its bottom surface 26. The reinforced section 28 extends through the center of the planar member 24 in opposite directions towards its periphery. This reinforced section 28 has a greater thickness of material than the planar member 24.

A reinforcing button 29 is located on the bottom surface 26 of planar member 24. The reinforcing button 29 is disposed approximately in the center of the cover 12 and projects outwardly from the reinforced section 28. Knock-out button 31 is disposed on the bottom surface 26 of planar member 24. This knock-out button 31 facilitates in the molding of cover 12. Although only one knock-out button 31 is shown in FIG. 3, a plurality of such knock-out buttons 31 may be employed.

Generally straight and parallel ribs 30, 32, 34, 36, surround the reinforced section 28. There are two ribs on each side of the reinforced section 28 to add further support to the planar member 24.

Adjacent the periphery of the bottom surface 26 of the planar member 24 is a first raised rim 38. First raised rim 38 extends a distance beyond the bottom surface 26 of the planar member 24 so as to engage the bottom edge 23 of the raised downwardly curved surface 22 when the cover 12 is engaged in the opening 14 of the container 10.

Cover 12 has a second raised rim 44 on the periphery of the top surface 42 of planar member 24. The second raised rim 44 has a generally rounded upper surface. The second raised rim 44 is elevated a distance above planar member 24 so it overlays the raised downwardly curved surface 22 when the cover 12 plugs the opening 14. The combined depth of the second raised rim 44 and the raised downwardly curved surface 22 is greater than the depth of the raised flange 18.

The diameter of the first raised rim 38 is greater than that of the planar member 24, but less than that of the first raised rim 38 and the second raised rim 44.

In a preferred embodiment of the present invention, four lugs (only two lugs 56, 58 are shown in FIG. 3) are disposed approximately equidistant on the outer edge of the second raised rim 44. The lugs 56, 58 extend outwardly a short distance so as to engage the bottom 23 of the raised downwardly curved surface 22. The purpose of lugs 56, 58 is to hinder the cover 12 from being removed with one's fingers and/or teeth from any position without exercising the child-resistant mode as described hereinbelow. The lugs 56, 58 do not, however, require any particular orientation in the engagement or disengagement of the cover 12 with the opening 14.

A tab 46 extends outwardly from the second raised rim 44. The tab 46 is generally aligned with the reinforced section 28. The outer periphery of tab 46 can be curved as shown in FIG. 2 and have a raised section 48 to facilitate a user's forefinger (on the top of the tab 46) and thumb (on the bottom of the tab 46).

The cover 12 as described herein is a child-resistant closure. However, it is not necessary that such closure be child-resistant, but only that it have a top configuration to facilitate stacking.

A child-resistant closure can be utilized in conjunction with this invention as described in greater detail in my co-pending patent application Ser. No. filed on even date herewith titled "Child-Resistant Closure Unit". As a child-resistant closure, the cover 12 is engaged in the opening of the container 10 by pressing down on the cover 12 until it is snapped in place (a snapping noise is heard). To disengage the cover 12, one presses down (preferably with one's thumb) in the center of the top surface 42 of the planar member 24 adjacent the "bull-seye" 50 which is disposed between arrows 52, 54. Simultaneously, one pulls in an upward direction on tab 46 with the forefinger and thumb of the other hand. Removal of the cover 12 thus requires two-handed operation. One hand is required to depress cover 12, while the other hand is required to pull upward on the tab 46.

The bottom end wall 60 of the container 10' is generally circular and has an axially extending chime 66 on its periphery. One function of the chime 66 is to raise the bottom end wall 60 of the container 10 above the surface it rests on.

An annular raised ring 62 is disposed between the center of the bottom end wall 60 and the chime 66. The depth of the chime 66 is greater than the depth of the annular raised ring 62. The annular raised ring 62 is of sufficient dimensions and proper location so as to snugly friction interlock with the inner periphery of rim 44 on a cover 12 of another container 10 of duplicate construction so as to firmly couple container 10 in stacked relation to container 10'. In such configuration, the containers 10, 10' may be tilted at a substantial angle from vertical without separating the coupled containers 10, 10'.

When the containers 10, 10' are stacked one upon another, the annular raised ring 62 of container 10' is adjacent to the inner wall 64 of the second raised rim 44 of container 10 so as to form a male-female coupling (the male member is on the bottom end of container 10'; the female member is on the top end of the container 10). The annular raised ring 62 on the bottom end 60 of container 10' is thus sized to fit into a recess formed on the cover 12 of container 10.

In the stacked arrangement of the containers 10, 10', the chime 66 on the bottom end 60 of container 10' rests upon the axially extending raised flange 18 on the top end wall 16 of the container 10 beneath it. When containers 10, 10' are in a stacked configuration, the combined depths of the chime 66 of container 10' and the raised flange 18 of container 10 is greater than the distance that the second raised rim 44 is elevated from the top end wall 16 of container 10. Accordingly, the cover 12 of container 10 bears essentially none of the weight of the container 10' above it, but acts solely as a locking device in the stacking configuration. The rounded upper surface of the second raised rim 44 allows for the containers 10, 10' to be easily engaged and disengaged with the smoothness of the inner wall 64 of the second raised rim 44 facilitating in the engagement and disengagement of the containers 10, 10'.

The axially extending chime 66 on the bottom end wall 60 of container 10 serves two functions. First, in the stacking configuration of the containers, it transfers the weight from an upper container to the container beneath it. Thus, no weight is directly applied to the cover 12 itself. Secondly, the chime 66 extends out beyond the side wall 11 of the container 10 approximately the same distance as the raised flange 18. Thus, when identical containers are placed side-by-side, a uniform space is maintained between the containers (cans). This space between adjacent containers reduces the possibility of scuffing of the outer surface (side wall 11) of the containers and of any label affixed thereto. Such scuffing may be caused by vertical or horizontal abrasion between containers (cans) during transit or on display shelves. Further, the chime 66 greatly enhances the aesthetics of the container.

In a preferred embodiment of this invention, the chime 66 is of a integral construction with the side wall 11 of container 10. Furthermore, the chime 66 and the side wall 11 of container 10 are preferably formed from a plastic material.

The stackable containers of the present invention are of great benefit to merchants. Most retail shelves offer at least 10 inches of height for displaying products. It is thus to the advantage of merchants to be able to place as many products as possible within the limited amount of space that is available. By stacking products, merchants are able to reduce by amount half the amount of room required to display a given product.

The stackable containers of the present invention allow for the uppermost container to be locked into place by the supporting container beneath it by both the weight of the upper container and the locking feature of the closure. This locking feature is deactivated by lifting or tilting at a sufficient angle the upper container away from the supporting container beneath it.

The present invention may be embodied in other specific forms without departing from the spirit or essential attributes thereof and, accordingly, reference is made to the appended claims, rather than to the foregoing specification, as indicating the scope of the invention.

I claim:

1. A stackable, closable container comprising:

a generally cylindrical body portion having an upper and a lower end, a generally circular top end wall joined to said upper end of said body portion, said top end wall having a generally circular opening with a raised downwardly curved surface on its periphery, said top end wall also having an axially extending raised flange with a generally rounded upper surface disposed on its periphery, a removable, generally circular, cover engaging said opening, said cover having a top and bottom surface, said cover having a raised rim on the periphery of its top surface, when said cover closes said opening the top of said raised rim overlaying the top of said raised flange, said cover further including a raised border projection on the periphery of its bottom surface for engaging the bottom of said raised downwardly curved surface of said opening, and a generally circular bottom end wall joined to said lower end of said body portion, said bottom end wall having an axially extending chime on its periphery and an annular raised rings, the chime being of integral construction with the container body portion, the depth of the chime being greater than the depth of the raised ring, said annular raised ring disposed between the center of said bottom end wall and said chime, said annular raised ring of sufficient dimensions, configuration, and proper location so as to snugly friction interlock with said cover of another container of duplicate construction of that as defined above so as to firmly couple one container in stacked relation to another container such that the containers may be tilted at a substantial angle from the vertical without separating the coupled containers and when such containers are in stacked relation, the chime of one container rests on the raised flange of the container beneath it, with the combined depths of said chime and raised flange greater than the distance from the top end wall of the container to the top of said raised rim of the cover so that the cover of the lower container bears essentially none of the weight of the upper container but acts solely as a locking device.

2. A stackable, closable container in accordance with claim 1 wherein the depth of said chime is greater than the depth of said annular raised ring.

3. A stackable, closable container according to claim 1 wherein in stacked configuration the bottom end of the container acts as a male member and the closure on the top end of the container beneath it acts as a female member.

* * * * *

UNITED STATES PATENT AND TRADEMARK OFFICE

CERTIFICATE OF CORRECTION

PATENT NO. : 4,485,923

DATED : December 4, 1984

INVENTOR(S) : Ralph A. Schwaikert

It is certified that error appears in the above-identified patent and that said Letters Patent is hereby corrected as shown below:

Column 3, line 32, after "raised rim 44." add --A connector flange 40 connects the first raised rim 38 and the second raised rim 44.--

Signed and Sealed this

*Seventh* Day of *May 1985*

[SEAL]

*Attest:*

DONALD J. QUIGG

*Attesting Officer* *Acting Commissioner of Patents and Trademarks*